United States Patent [19]

Lee

[11] 4,372,007

[45] Feb. 8, 1983

[54] RELEASEABLE HINGE MECHANISM

[75] Inventor: Hugh Lee, San Jose, Calif.

[73] Assignee: Atari, Inc., Sunnyvale, Calif.

[21] Appl. No.: 223,649

[22] Filed: Jan. 8, 1981

[51] Int. Cl.[3] ..... E05D 11/10

[52] U.S. Cl. ..... 16/260; 16/254

[58] Field of Search ..... 16/260, 270, 257, 225, 16/232, 250, 254, 255, 257, 259, DIG. 13; 220/334, 335, 340, 341; 249/121

[56] References Cited

U.S. PATENT DOCUMENTS 3,833,964 9/1974 Harcourt ..... 220/335 X 4,129,922 12/1978 Law ..... 16/DIG. 13

*Primary Examiner*—Paul A. Bell

*Assistant Examiner*—John S. Brown

*Attorney, Agent, or Firm*—Townsend and Townsend

[57] ABSTRACT

A releaseable hinge mechanism for use with a cover member, a bottom housing member having a deflectable support wall and a top housing member having a facing margin adjacent the support wall. A hinge is connected to the cover member and includes a central elongate portion terminating in a flatted distal end with a pair of flanking pivot pin portions received in a pair of cradle members located on the support wall. A compound bracket located on the facing margin has a spaced pair of relatively inflexible brace portions in facing relation with the flatted distal end and normally engaged in surface contact with the flatted end when the cover member is opened. The compound bracket includes a deflectable finger located between the pair of brace portions and arranged for surface contact with a pressure finger located on the top edge of the flatted distal end when the cover member is moved between a closed position and the opened position. The bracket further includes a spaced pair of retaining fingers extending over the distal end of the hinge to restrict upward movement of the pivot pin portions away from the cradle members until the cover member is forceably moved to an overtravel position in which the support wall is progressively deflected away from the facing margin by contact between the lower edge of the flatted surface and the brace portions until the distal end of the hinge is released from the retaining fingers.

6 Claims, 8 Drawing Figures

RELEASEABLE HINGE MECHANISM

This invention relates to hinge mechanisms of the type used to pivotally secure together two members, such as a top cover and a main housing member.

Many types of hinge mechanisms have been designed in the past to provide pivotal closure for two complementary members, such as a cover and a housing, and further to provide a detent in one or more open positions. With the increasing use of molded plastic materials for housings and cover members, many hinge configurations are unsuitable for practical use due to excessive stresses placed on thin plastic regions. This is especially true for the case of hinge mechanisms employing separate metal pieces.

Even when molded as part of the complementary enclosure members, many hinge mechanisms have been found to rupture when excessive overtravel is forced upon the pivoting member by a user. Other mechanisms do not rupture, but the coacting members separate and cannot be readily reassembled by the user.

SUMMARY OF THE INVENTION

The invention comprises a releaseable hinge mechanism which is capable of being molded into the complementary closure or housing members and which provides both a detent function and an overtravel release function.

The invention is particularly adapted for use with a two-piece housing and a separate cover designed to be raised to an open detented position. The hinge portion of the mechanism according to the invention is integrally molded to the cover member and includes a central body portion having a distal end with a flatted surface flanked by a pair of pivot pin portions. A pressure finger extends slightly outwardly from the upper edge of the flatted portion from a location aligned with the axis of the pivot pin portions.

The pivot pin portions are cradled in a pair of supports formed on an upstanding support wall portion of the base member of the housing with which the cover member is associated. The top portion of the associated housing is provided with a compound bracket portion having a laterally spaced pair of fingers extending inwardly over the top of the distal end of the hinge portion a short distance for the purpose of normally retaining the hinge portion in the cradle. The bracket-like portion also includes a central upstanding bendable finger which is contacted by the pressure finger of the hinge portion to provide frictional resistance during motion of the cover. Each of the inwardly extending fingers has a beveled rear surface terminating in a brace portion having an essentially flat surface coplanar with the surface of the bendable finger and which bears against the flatted surface of the hinge portion when the cover is in the normal fully extended open position in order to provide positive detent to the cover member. The brace portions of the compound bracket are substantially more rigid than the wall surface adjacent the cradle so that, upon forced rotation of the cover member past the open detent position, the flatted end of the hinge portion bears against the brace portion surfaces and deflects the cradle wall away from the brace portion surfaces until the distal end of the hinge portion clears the retaining fingers and is released upwardly. In this way, forced overtravel of the cover member merely results in release of the hinge from its captured position without breakage of any of the hinge component parts. Most importantly, the hinge can be easily reinstalled by the user.

For a fuller understanding of the nature and advantages of the invention, reference should be had to the ensuing detailed description, taken in conjunction with the accompanying drawings.

DESCRIPTION OF THE PREFERRED EMBODIMENT

Figure 1:
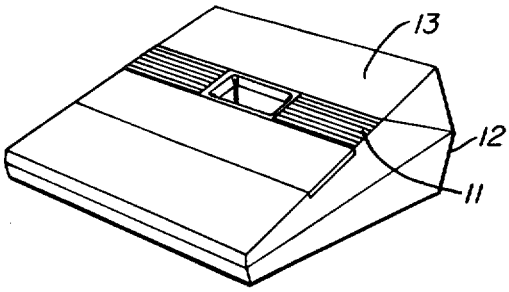
FIG. 1 is a schematic perspective view of a housing embodying the invention.

Turning now to the drawings, FIG. 1 illustrates in schematic perspective form a housing having a top portion 11, a bottom portion 12, and a pivotable cover member 13, the cover being arranged for pivotal operation from the closed position illustrated to an open position.

Figure 2:
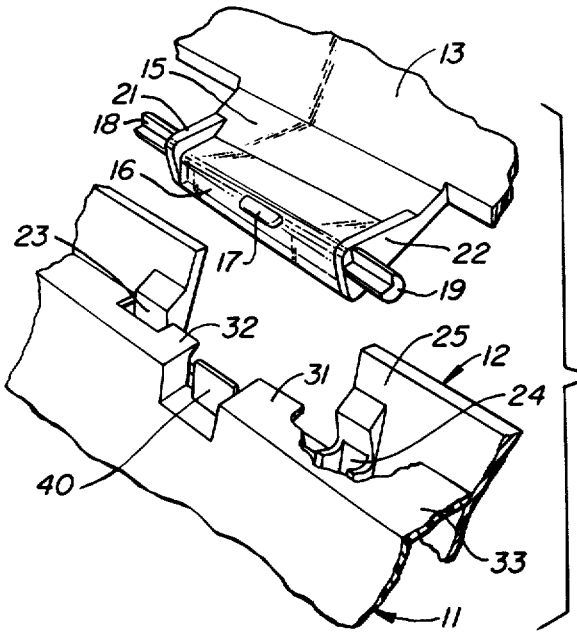
FIG. 2 is an exploded detail view illustrating the preferred embodiment of the invention.

With reference to FIG. 2, molded to the lower rear edge wall of the cover member 13 is a hinge having a central portion 15 terminating at the distal end in a generally flatted surface 16 having a pressure finger portion 17 and a pair of flanking pivot pin portions 18, 19. A pair of stiffening ribs 21, 22 are provided at each edge of the central body portion 15.

Pin portions 18, 19 are cradled in a pair of cradle portions 23, 24 of identical configuration which are formed on the inner surface of the back wall 25 of bottom housing member 12. The hinge member is retained in the cradles 23, 24 by means of retaining finger portions 31, 32 formed in the upper back ledge 33 of top housing member 11. Each retaining finger portion 31, 32 has a beveled rear edge surface 35, 36 which blends into a vertically arranged surface 38, 39 in a thickened brace portion having a generally U-shaped configuration. Extending upwardly in the central portion between brace surfaces 38, 39 is a relatively thin bendable pressure finger 40 engageable with pressure finger 17 during operation of the cover member 13. The coaction between elements 40 and 17 provides a frictional drag to the pivotal movement of the cover member and a positive detent action when the cover member is closed.

Figure 3A:
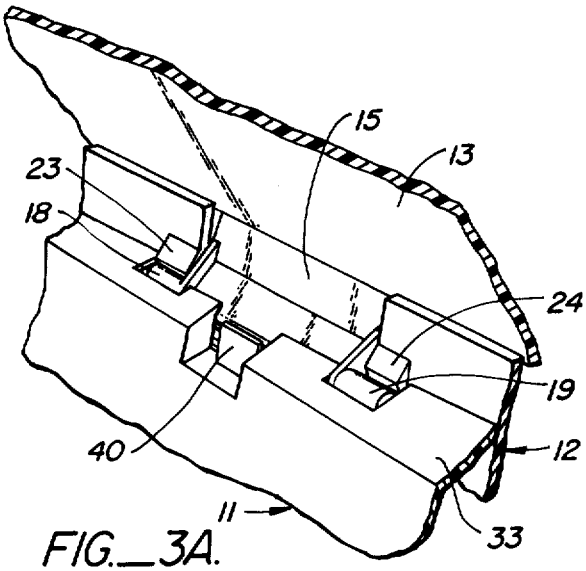
FIGS. 3A-3D are sequential detail views illustrating the operation of the invention.

The operation of the preferred embodiment of the invention may best be understood with reference to FIGS. 3A-3D. FIG. 3A illustrates the hinge mechanism with cover 13 in the closed position. In this configuration, pivot pin portions 18, 19 are fully cradled and retaining fingers 31, 32 extend over the top edge of the central portion 15 of the hinge. Pressure finger 17 is positioned at the base of pressure finger 40.

Figure 3B:
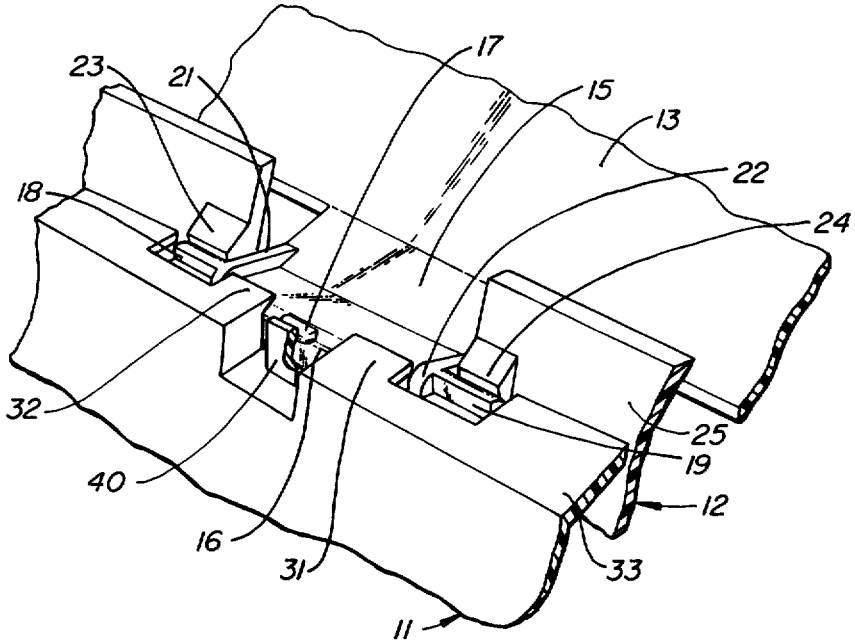

With reference to FIG. 3B, which illustrates the cover member 13 in the fully open position, pin portions 18, 19 are still fully cradled and pressure finger 17 contacts the upper rear surface of pressure finger 40. Detent is provided by surface contact between the flatted surface 16 of hinge portion 15 and brace surfaces 38, 39.

Figure 3C:
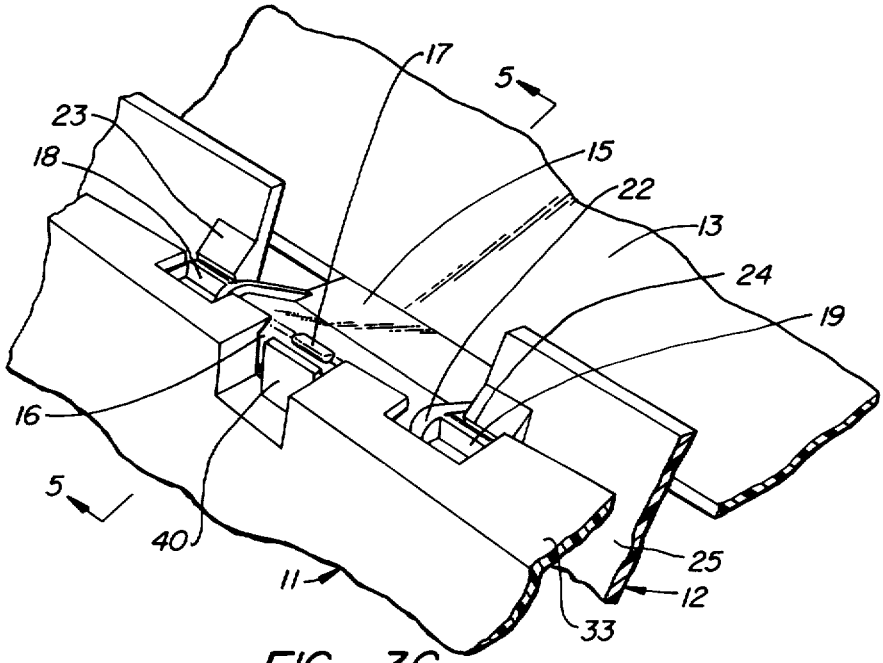
Figure 3D:
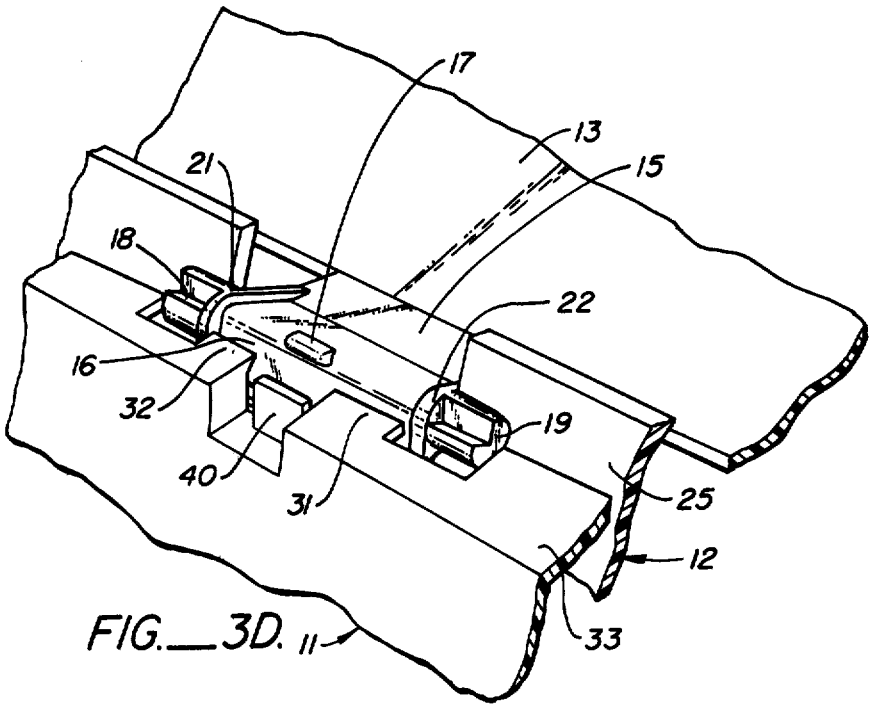
Figure 4:
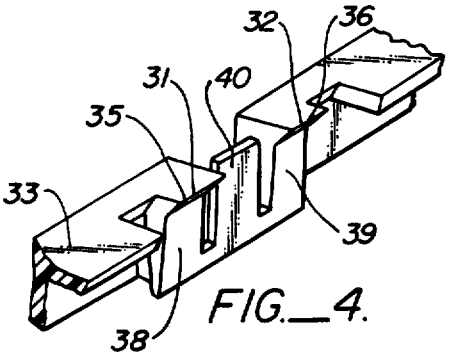
FIG. 4 is a partial perspective view illustrating the compound bracket portion of the invention.
Figure 5:
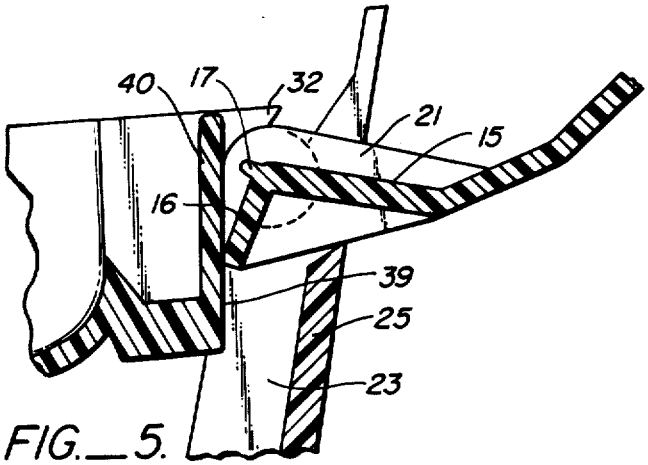
FIG. 5 is a sectional view taken along line 5—5 of FIG. 3C illustrating the release mechanism.

FIG. 3C illustrates the hinge mechanism when cover 13 is forced to an overtravel position. As seen in this Fig., cover 13 has been rotated to a position in which pressure finger 17 has traveled beyond the upper surface of pressure finger 40. As best shown in FIG. 5, the lower edge of the flatted distal end surface 16 of central hinge portion 15 bears against the bracing surfaces 38, 39 causing the back wall 25 of bottom housing member to be deflected rearwardly. As the overtravel increases, the deflection continues until the distal end portion of the hinge portion 15 clears the retaining fingers 31, 32, after which the hinge is freed to be lifted off the cradles 23, 24 by virtue of contact between the bottom surface of hinge portion 15 and the upper edge of back wall 25. The result is shown in FIG. 3D. After the hinge has been released, the mechanism may be easily reinstalled on the cradles 23, 24 by downward pressure applied through the cover 13 and slight backward pressure on rear wall 25.

As will now be apparent, the invention affords a low-cost, simple and durable hinge mechanism providing both detent and releaseable engagement for a cover member pivotally mounted to a housing having top and bottom portions. In addition, after release, the hinge can be readily reinstalled by the user without the need for any special tools or expertise. It should be understood that, in the embodiment disclosed, there are two hinge mechanisms, one adjacent each end of the unit, each having an identical configuration to that illustrated for the single hinge mechanism.

While the above provides a full and complete disclosure of the preferred embodiment of the invention, various modifications, alternate constructions and equivalents may be employed without departing from the true spirit and scope of the invention. Therefore, the above description should not be construed as limiting the scope of the invention which is defined by the appended claims.

What is claimed is:

1. In combination, a releaseable hinge mechanism, a cover member and a base member having a deflectable support wall and a facing margin adjacent said support wall, said mechanism comprising:

a hinge connected to said cover member, said hinge including a central elongate portion having a flatted distal end and a pair of pivot pin portions flanking said distal end, said distal end including a pressure finger extending outwardly from the top edge;

a pair of cradle members located on said support wall for releaseably receiving said pivot pin portion; and compound bracket means located on said facing margin, said bracket means including a spaced pair of relatively inflexible brace portions in facing relation with said flatted distal end and normally engaged in surface contact therewith when said cover member is in an opened position, said bracket means further including a deflectable finger portion located between said pair of brace portions and arranged for surface contact with said pressure finger when said cover member is moved between a closed position and said opened position, said bracket means further including a spaced pair of retaining fingers extending over said distal end of said hinge to restrict movement of said pivot pin portions away from said cradle members, whereby overtravel of said cover member past said opened position causes the lower edge of said flatted distal end to engage said brace portions and progressively deflect said support wall away from said facing margin until said distal end is released from said retaining fingers.

2. In combination, a releaseable hinge mechanism, a first member and a second member having a deflectable support wall and a facing margin adjacent said support wall, said mechanism comprising:

a hinge connected to said first member, said hinge including a central elongate portion having a flatted distal end and a pair of pivot pin portions flanking said distal end, said distal end including a pressure finger extending from said central elongate portion towards said facing margin;

a pair of cradle members located on said support wall for releaseably receiving said pivot pin portion; and compound bracket means located on said facing margin, said bracket means including a spaced pair of relatively inflexible brace portions in facing relation with said flatted distal end and normally engaged in surface contact therewith when said first member is in an opened position with respect to said second member, said bracket means further including a deflectable finger portion located between said pair of brace portions and arranged for surface contact with said pressure finger when said first member is moved between a closed position with respect to said second member and said opened position, said bracket means further including a spaced pair of retaining fingers extending over said distal end of said hinge to restrict movement of said pivot pin portions away from said cradle members, whereby overtravel of said first member past said opened position causes the lower edge of said flatted distal end to engage said brace portions and progressively deflect said support wall away from said facing margin until said distal end is released from said retaining fingers.

3. The combination of claim 1 or 2 wherein said hinge includes a pair of stiffening ribs flanking said central elongate portion.

4. The combination of claim 1 or 2 wherein each of said spaced pair of bracket means retaining fingers surmounts a different one of the spaced pair of brace portions and is integrally molded therewith.

5. The combination of claim 4 wherein each brace portion includes a flat outer surface portion extending toward the surmounted bracket means retaining finger, and wherein each bracket means retaining finger has a beveled surface which blends into the flat surface portion of the corresponding brace portion.

6. In a housing assembly having a cover member with a rear wall and a base member having a deflectable support wall and a facing margin adjacent said support wall, a plurality of releaseable hinge mechanisms spaced along said rear wall and said support wall, each said hinge mechanism comprising:

a hinge connected to said cover member, said hinge including a central elongate portion having a flatted distal end and a pair of pivot pin portions flanking said distal end, said distal end including a pressure finger extending outwardly from the top edge;

a pair of cradle members located on said support wall for releaseably receiving said pivoted pin portion; and compound bracket means located on said facing margin, said bracket means including a spaced pair of relatively inflexible brace portions in facing relation with said flatted distal end and normally engaged in surface contact therewith when said cover member is in an opened position, said bracket means further including a deflectable finger portion located between said pair of brace portions and arranged for surface contact with said pressure finger when said cover member is moved between a closed position and said open position, said bracket means further including a spaced pair of retaining fingers extending over said distal end of said hinge to restrict movement of said pivot pin portions away from said cradle members, whereby overtravel of said cover member past said opened position causes the lower edge of said flatted distal end to engage said brace portions and progressively deflect said support wall away from said facing margin until said distal end is released from said retaining fingers.

* * * * *